United States Patent [19]

Shilo

[11] Patent Number: 4,893,817

[45] Date of Patent: Jan. 16, 1990

[54] MUSICAL JIGSAW-TYPE PUZZLE

[76] Inventor: Ronen Shilo, 1575 Tenaka Pl. #01, Sunnyvale, Calif. 94087

[21] Appl. No.: 258,822

[22] Filed: Oct. 17, 1988

[51] Int. Cl.[4] ..... A63F 9/10

[52] U.S. Cl. ..... 273/157 R; 434/330; 434/333; 434/340

[58] Field of Search ..... 273/156, 157 R; 434/338, 339, 340, 330, 333

[56] References Cited

U.S. PATENT DOCUMENTS

| | | | |
|---|---|---|---|
| 2,918,287 | 12/1959 | Rosenblum et al. | 273/156 |
| 3,015,895 | 1/1962 | Stall | 273/157 R X |
| 3,864,848 | 2/1975 | Smith | 434/340 |
| 4,333,657 | 6/1982 | Jaworski et al. | 273/376 |
| 4,417,732 | 11/1983 | Guill | 273/157 R X |
| 4,796,891 | 1/1989 | Milner | 273/153 S |

*Primary Examiner*—Anton O. Oechsle

*Attorney, Agent, or Firm*—Julian Caplan

[57] ABSTRACT

Pieces of a conventional jigsaw picture puzzle are cut to fit within a frame and over a base. Each piece has a suitable actuator (e.g., a magnet) embedded therein. The base has a switch (e.g., a magnetic switch) located below the location of the magnet of a particular piece when that piece is properly positioned within the frame to "solve" the puzzle. The switches are wired in series with a source of power, a melody generator and an amplifier. When the puzzle pieces are in proper position, the melody generator produces a tune appropriate for the picture of the puzzle. Several different puzzles may be provided fitting within the same frame. For each puzzle there is a key piece. For different puzzles the switch actuator of the key piece of located in a different location. A separate switch is located on the base below each actuator of the key piece and is wired to generate a different tune by being in series with a different melody generator. Instead of generating tunes, the device may actuate lights or speech.

4 Claims, 2 Drawing Sheets

MUSICAL JIGSAW-TYPE PUZZLE

BACKGROUND OF THE INVENTION

1. Field of the Invention

This invention relates to a new and improved jigsaw-type puzzle characterized by the fact that when all of the pieces are in proper position so that the puzzle is solved, switches are closed to energize a melody generator which plays a tune appropriate to the subject of the picture of the puzzle.

2. Description of Prior Art

Jigsaw puzzles are, of course, well known. The use of a single base and frame to be used with different puzzle pieces to display different pictures is also well known. The present invention differs from prior jigsaw puzzles in that the individual pieces contain switch actuators which interact with switches in the base of the puzzle wired in series with a source of power, a melody generator, and an amplifier. Hence, when all of the pieces are in proper place, a tune is played.

A commercially available jigsaw puzzle which also plays a tune is produced by ILLCO, Hong Kong. The central piece of this puzzle has a tape player and battery embedded therein and has microswitches on each of its side edges. When the pieces are all in the proper position, the microswitches are closed and a circuit is completed to energize the tape player. The present invention has many differences and advantages over the foregoing structure as hereinafter appears.

The components used in the electrical circuitry of the present invention are themselves old, but the combination hereinafter described in detail has advantages and distinctions over the prior art offering considerable advantages over the prior art.

SUMMARY OF THE INVENTION

A base having an edge frame receives the individual pieces of a jigsaw puzzle such that when the pieces are properly positioned a picture is displayed. Embedded in each of the pieces is a switch actuator which in the preferred embodiment hereinafter described comprises a magnet. Embedded in the base at locations directly under each of the magnets are magnetically operated switches such as reed switches. The switches are wired in series with a source of power and with a melody generator and with an amplifier. When all of the pieces are in place, the switches are closed and the melody generator plays a tune appropriate to the puzzle picture.

Different puzzles having different pictures may be used with the same base. It is desirable that a different tune be played for each puzzle. To accomplish this function, a key piece of a first puzzle has a magnet located in one location, while the corresponding key piece of the second puzzle has a magnet in a different location. In the base there is a first switch wired to a first melody generator beneath the magnet of a first particular puzzle and a second switch wired in series with a second melody generator at a location below the magnet of the key piece of the second puzzle.

Other objects of the present invention will become apparent upon reading the following specification and referring to the accompanying drawings in which similar characters of reference represent corresponding parts in each of the several views.

IN THE DRAWINGS

DESCRIPTION OF PREFERRED EMBODIMENTS

Figure 1:
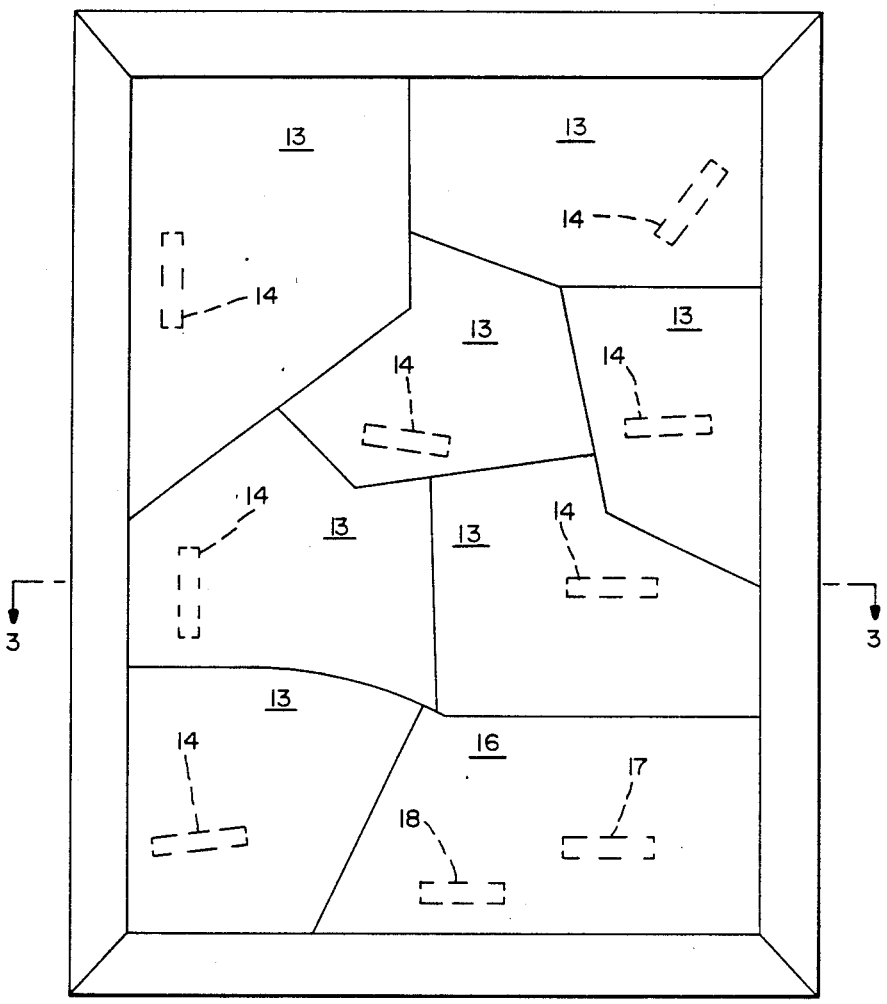
FIG. 1 is a top plan view of a puzzle in accordance with the present invention.
Figure 3:
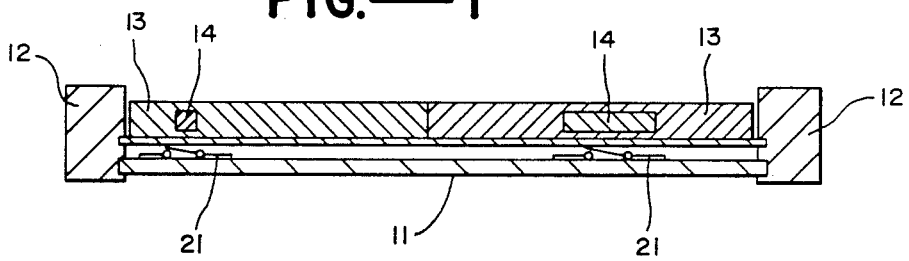
FIG. 3 is a sectional view taken substantially along the line 3—3 of FIG. 1.
Figure 2:
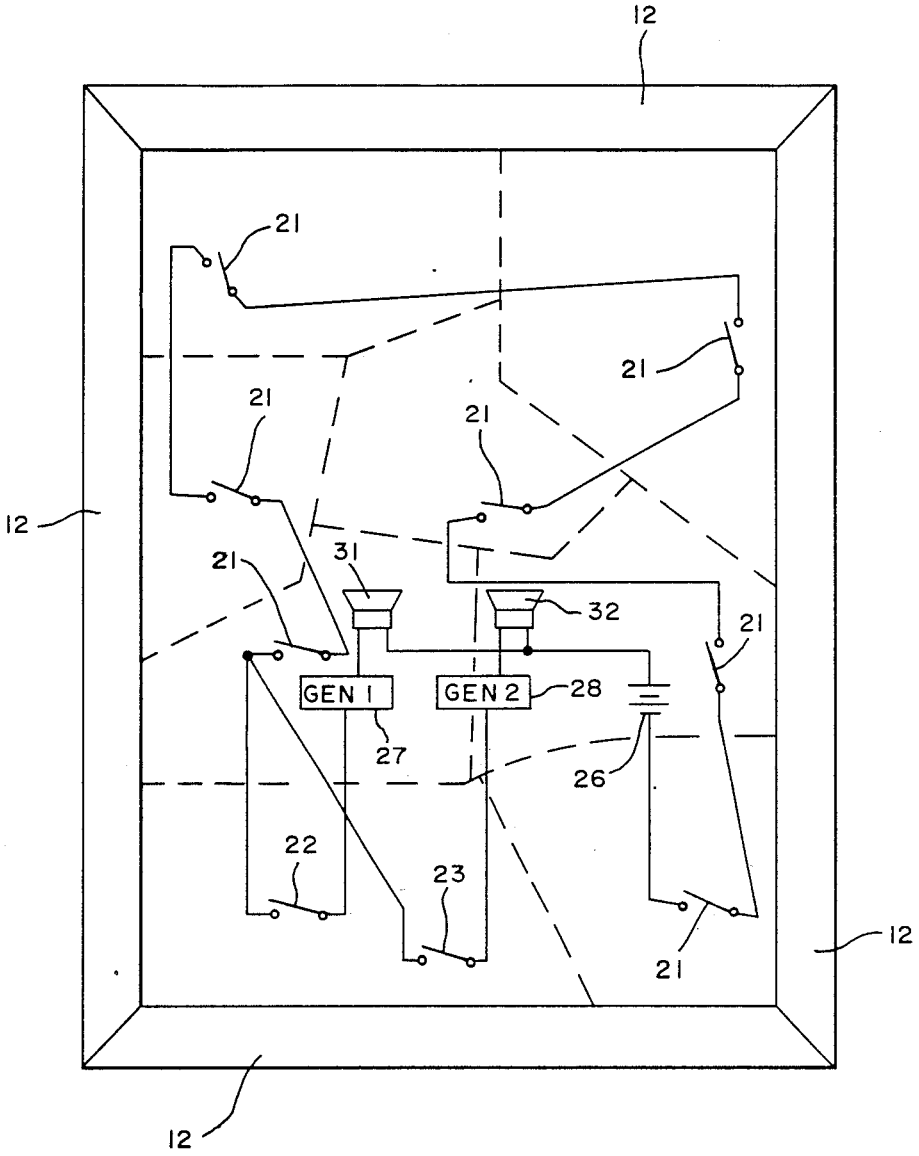
FIG. 2 is a somewhat schematic view of the base of the puzzle with the puzzle pieces shown in dot-and-dash lines, the view being somewhat schematic in that the wiring of the electrical components is also displayed therein.

Base 11 is provided with edge frame members 12. Fitting within the frame members are the individual pieces 13 which comprise the puzzle. The upper face of each piece 13 has a portion of a picture thereon, so that when all of the pieces are in place the picture is displayed.

In a preferred embodiment, embedded within each piece 13 is a magnet 14. Embedded in base 11 are magnetic switches 21 (such as reed switches), there being a switch 21 under each magnet 14. Hence, proper positioning of a piece 13 causes the magnet 14 to close the corresponding switch 21. At a suitable location such as a recess in the bottom of the base 11 is a source of power which may be a 1.5 volt dry battery 26. There is also embedded in the base 11 a melody generator 27 connected to audio amplifier 31. Melody generators are commercially available. One appropriate melody generator is Archer Model UM3482A Melody Generator. This is a mask-ROM-programmed multi-instrument melody generator, implemented in the CMOS technology. It plays melodies according to programmed information. Incorporated in the device is a preamplifier which provides simple interface to the driver circuit. It will be understood, of course, that other melody generators may be employed. Further, the circuit instead of generating tunes may actuate lights or speech, or may energize a remote control device which turns on a tape recorder or other electronic instrument.

The base 11 and frame 12 may accommodate the pieces of several different pictures so that different puzzles may be solved. As illustrated herein, a different melody may be played for each separate puzzle. Thus, one of the pieces other than the pieces 13 may be designated a key piece 16. The key piece 16 for the first puzzle has embedded therein a first magnet 17. The key piece 16 for a second puzzle has embedded a second magnet 18. The relative location of magnet 18 is different from magnet 17. In base 11 below magnet 17 is a first switch 22 connected to first melody generator 27 and amplifier 31. Below the location of a second magnet 18 is a second switch 23 wired in parallel with the switch 22, but in series with second generator 28 and second amplifier 32. Thus, either the generator 27 or the generator 28 may be energized depending on whether the key piece 16 is from one puzzle or the other. It will be appreciated that the number of generators 27, 28 is subject to variation in that any practical number of tunes may be played by the device. It will also be understood that instead of individual amplifiers 31, 32, each of the generators may be wired to a common generator 31.

Assuming, for example, that the first puzzle is a picture of Santa Claus, the tune of generator 27 may be "Santa Claus is Coming to Town" and if the second puzzle is a picture of a rabbit, generator 28 may play "Here Comes Peter Cottontail".

Although in the preferred embodiment, each of the pieces 13 and 16 is of the same shape for different puzzles, it will be understood that different shapes for different puzzles may be used. It is essential that, when all of the pieces are in place, there be a magnet 14 directly over each of the switches 21 and that at least one of the key switches 22, 23 be closed by reason of the positioning thereabove of a key piece magnet 17, 18. The latter may be on the key piece or different pieces.

Instead of magnetic switches, mechanically actuated switches may be used, the puzzle piece having a projection which interacts with a part of the switch. Additionally, the puzzle piece may have a conductive piece which shunts the gap between open switch contacts. Other switch actuators and switches are contemplated.

What is claimed is:

1. A jigsaw-type puzzle comprising a base having edge frame members, a plurality of irregularly-shaped puzzle pieces each having a portion of a picture on its upper face, said puzzle pieces being shaped to fit together resting on said base within said frame members, at least some of said puzzle pieces having switch actuating means, said base having switch means in positions corresponding to said switch actuating means when said puzzle pieces are fitted together, said switch actuating means and said switches co-acting to close said switches when positioned in proximity to each other, a source of power, an electrical device, wiring to connect in series said switch means, said source of power and said electrical device, whereby said electrical device is energized only when all said puzzle pieces are fit together to fill the area above said base and within said frame members, a second plurality of second irregularly-shaped puzzle pieces each having second switch actuating means and a key puzzle piece having third switch actuating means, said base having second switch means and a second electrical device connected thereto, said second switch means and said second electrical device being in series with said source of power and said amplifier and to all but one of said first-mentioned switches, said second switch actuating means corresponding in position to all but one of said first-mentioned switch-actuating means when said second puzzle pieces are fit together to fill the area above said base and within said frame member, said third switch actuating means being positioned in proximity to said second switch means, whereby said second electrical device is energized and said first-mentioned electrical device is not energized.

2. A puzzle according to claim 1 in which at least one said electrical device comprises a melody generator.

3. A puzzle according to claim 2 which further comprises an amplifier driven by said melody generator.

4. A puzzle according to claim 1 in which at least one said switch actuating means comprises a magnet and at least one said switch means comprises a magnetically-closed switch.

* * * * *